US007442082B2

(12) United States Patent
Ma

(10) Patent No.: US 7,442,082 B2
(45) Date of Patent: Oct. 28, 2008

(54) SHIELDED CONNECTOR WITH FOLDING ARRANGEMENT ENSURING PERPENDICULARITY BETWEEN SIDEWALL AND BOTTOM WALL OF THE METAL HOUSING

(75) Inventor: Wen-Qiang Ma, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/009,012

(22) Filed: Jan. 15, 2008

(65) Prior Publication Data

US 2008/0182452 A1 Jul. 31, 2008

(30) Foreign Application Priority Data

Jan. 15, 2007 (TW) ..... 96200726 U

(51) Int. Cl.
*H01R 13/648* (2006.01)

(52) U.S. Cl. ..... 439/607; 439/71

(58) Field of Classification Search ..... 439/607, 439/71, 72, 330, 70
See application file for complete search history.

(56) References Cited

U.S. PATENT DOCUMENTS

| | | | | |
|---|---|---|---|---|
| 7,147,481 | B2 * | 12/2006 | Yang | 439/71 |
| 7,156,679 | B1 * | 1/2007 | Wang et al. | 439/330 |
| 7,160,116 | B2 * | 1/2007 | Li | 439/73 |
| 7,288,003 | B2 * | 10/2007 | Ono et al. | 439/607 |
| 7,309,238 | B2 * | 12/2007 | Yang | 439/71 |

* cited by examiner

*Primary Examiner*—Hien Vu
(74) *Attorney, Agent, or Firm*—Wei Te Chung

(57) ABSTRACT

An shielded connector (1) comprises a metal housing (10) configured by first, second, third, fourth sidewalls (102, 101, 103, 100) and a bottom wall (not labeled) defining a receiving space (104) therebetween, first and second terminal inserts securely attached to the first and third sidewalls of the metal housing respectively, first and second metal shield (40) assembled to the first and second terminal insert, and fastening means (50) extending from the metal shield, through the insulating housing and anchored to the first and third sidewalls of the metal housing, respectively. A slit (106) is formed at a portion between the sidewall and the bottom wall of the metal housing so as to improve a true perpendicularity therebetween.

11 Claims, 5 Drawing Sheets

SHIELDED CONNECTOR WITH FOLDING ARRANGEMENT ENSURING PERPENDICULARITY BETWEEN SIDEWALL AND BOTTOM WALL OF THE METAL HOUSING

BACKGROUND OF THE INVENTION

1. Field of the Invention

The present invention relates to a shielded connector, and more particularly to an electronic module connector for interconnecting an electronic module such as a camera module for use with a cellular phone or the like to an electrical member such as a printed circuit board. The connector includes a metal housing with a folding arrangement between the sidewall and the bottom wall so as to improve a true perpendicularity therebetween.

2. Description of the Related Art

Conventionally, electronic modules such as a camera module for use with a cellular phone are securely maintained in electrical connection with an electronic member such as a printed circuit board. Therefore, an electrical connector for the camera module, formed in a shape that allows for secure insertion of the camera module, is pre-installed on the printed circuit board. Then, the camera module is inserted into the electrical connector to electrically engage therewith. Consequently, the camera module is electrically connected with the printed circuit board via the shielded connector.

For example, known as an example of the aforementioned conventional technique is a camera module connector which is described in U.S. Patent Application Publication No. 2006-0216996. This connector comprises a metal shell defining a receiving space and mounted onto the printed circuit board, a pair of insulating housings attached to the two opposite sidewalls of the metal shell, a plurality of terminals attached to the insulating housings, and a pair of shielding shells covering on the insulating housings, respectively. The metal shell is a rectangular figure, being a metal board stamping and integrated by molded. And the metal shell comprises a bottom wall, first, second, third, and forth sidewall defining a receiving space therebetween. Each sidewall includes at least a locking finger so as to retain the camera module. Each terminal includes a tail portion and a contact engaging portion. The tail portion extends from the sidewall away from the receiving space. The contact engaging portion extends from the sidewall toward a center of the receiving space. When the camera module is inserted into the receiving space from above, the pads formed on the bottom face thereof are bought into the contact section of the terminals, meanwhile the locking finger contacts with the outer periphery of the camera module so as to hold the camera module in the receiving space steadily. Therefore, the shielded connector connects the camera module to the printed circuit board via the terminals.

However, during the manufacture, as we know that it is difficult to bent a metal board to a true rectangular figure. Therefore, the receiving space formed by the metal shell is not exactly fit to the shape of the configuration of the camera module. Since the locking finger is located on the sidewall, if the sidewall is not located at a true perpendicular/vertical position, the intended retaining force exerted from the locking finger to the camera module will be compromised. As a result, the camera module is not securely retained therein, and will easily fall off therefrom.

Thus, there is a need to provide an improved shielded connector that overcomes the above-mentioned problems.

BRIEF SUMMARY OF THE INVENTION

It is an object of the present invention to provide a shielded connector with a folding arrangement ensuring perpendicularity between the sidewall and the bottom wall of the metal housing.

In order to achieve the objective above, a shielded connector in accordance with a preferred embodiment of the present invention comprises a metal housing with four sidewalls and a bottom wall defining a receiving space upwardly, a pair of terminal inserts attached with the metal housing, and a pair of metal shield covering on the terminal inserts. Each terminal insert comprises a plurality of terminals secured within an insulating material, each terminal including a tail portion extending from the insert away from the sidewalls, and a contact engaging portion extending from the insert toward a center of the receiving space of the metal housing. And a slit is formed at the portion between the sidewall and the bottom wall of the metal housing. Therefore, the strength of the metal housing at a portion between the sidewall and the bottom wall is decreased. Therefore, it is easy to bend a metal board to a rectangular figure.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like members in the figures and in which:

DESCRIPTION OF PREFERRED EMBODIMENT OF THE INVENTION

In the following detailed description, for purposes of explanation, numerous specific details are set forth in order to provide a thorough understanding of the present invention.

A shielded connector according to the present invention is applicable to an electronic apparatus such as digital cameras, PDAs (Personal Digital Assistants), PCs (Personal Computers), mobile phones or the like. In the preferred embodiment illustrated in FIGS. 1-5, the shielded connector 1 is used in a mobile handset (not shown) for connecting a camera module (not shown) to a PCB (not shown).

Figure 1:
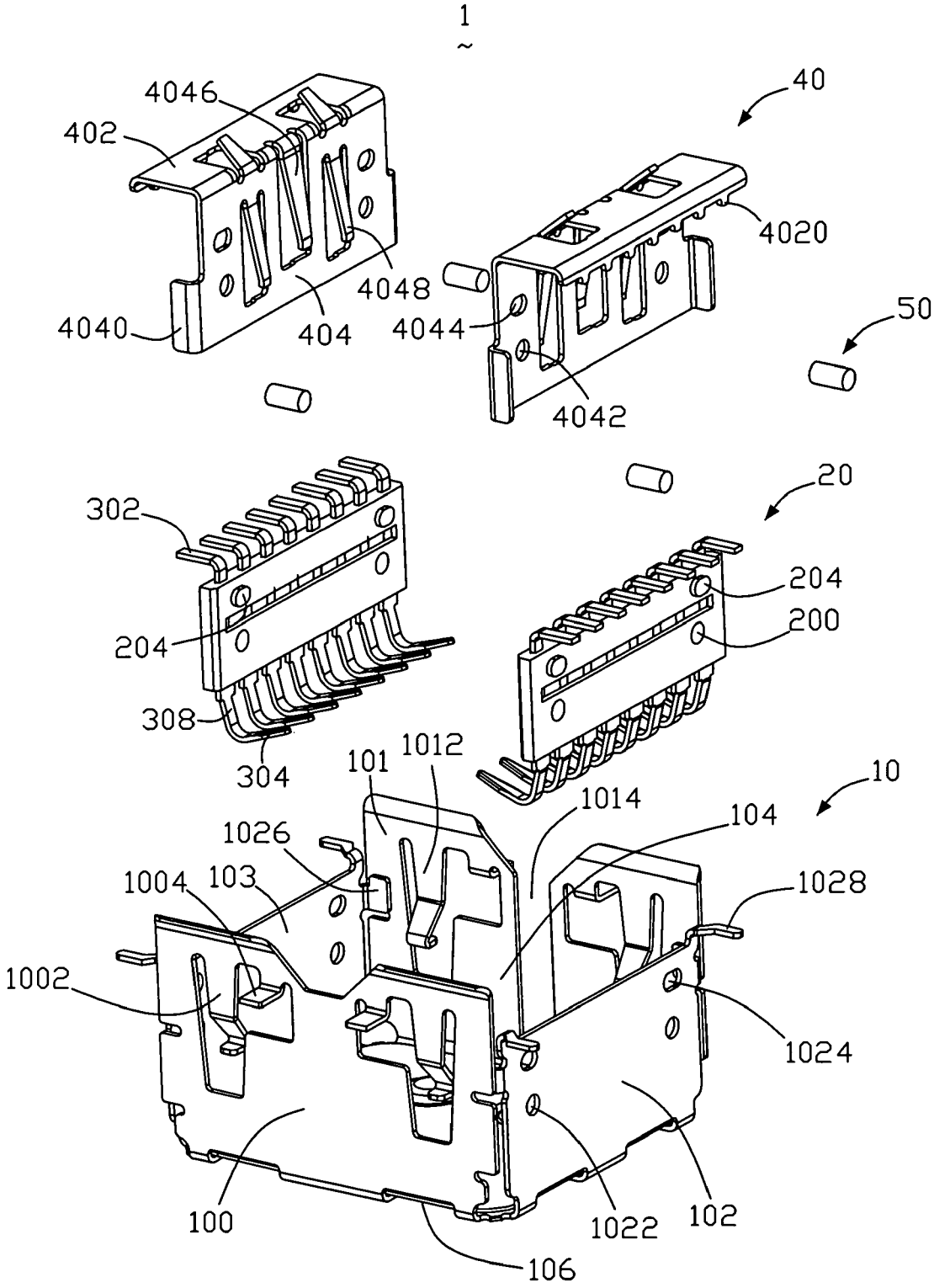
FIG. 1 is an exploded view of a shielded connector of the present invention, wherein the terminals are attached to the insulating housing.
Figure 2:
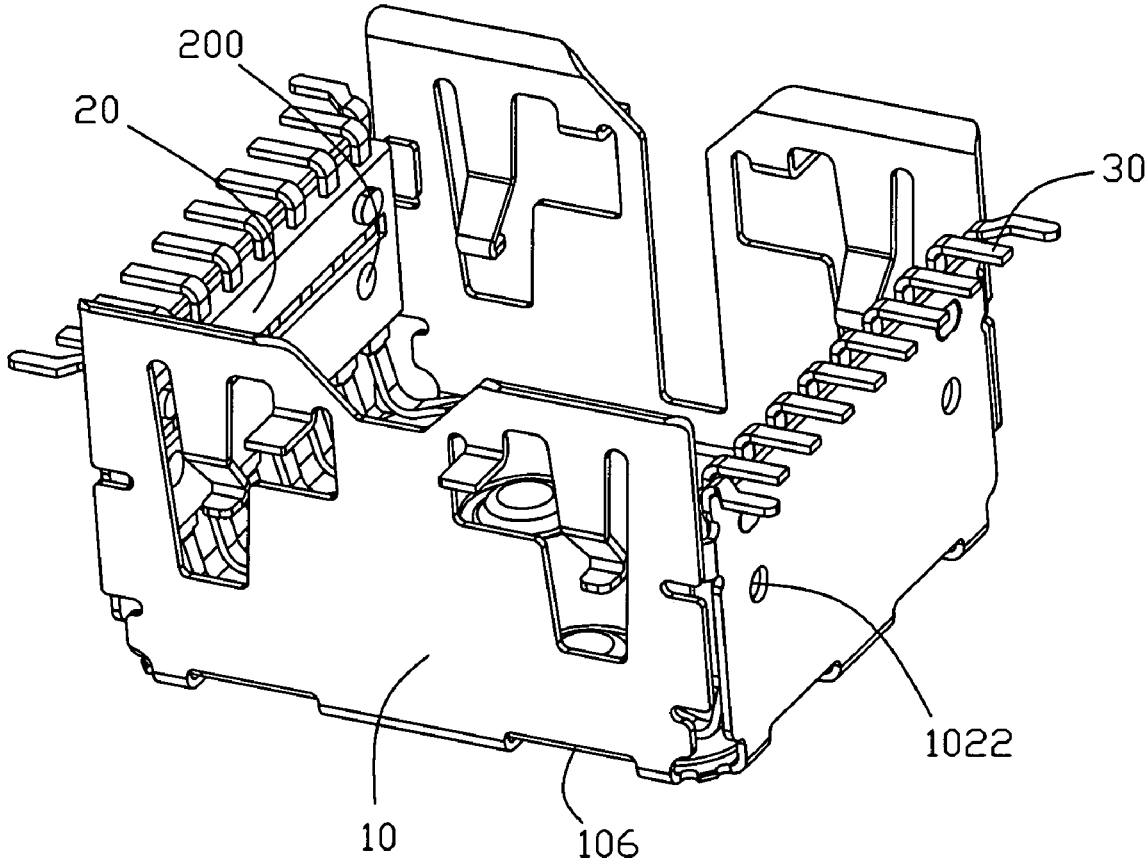
FIG. 2 is a partly assembled perspective view of the shielded connector of the present invention.
Figure 3:
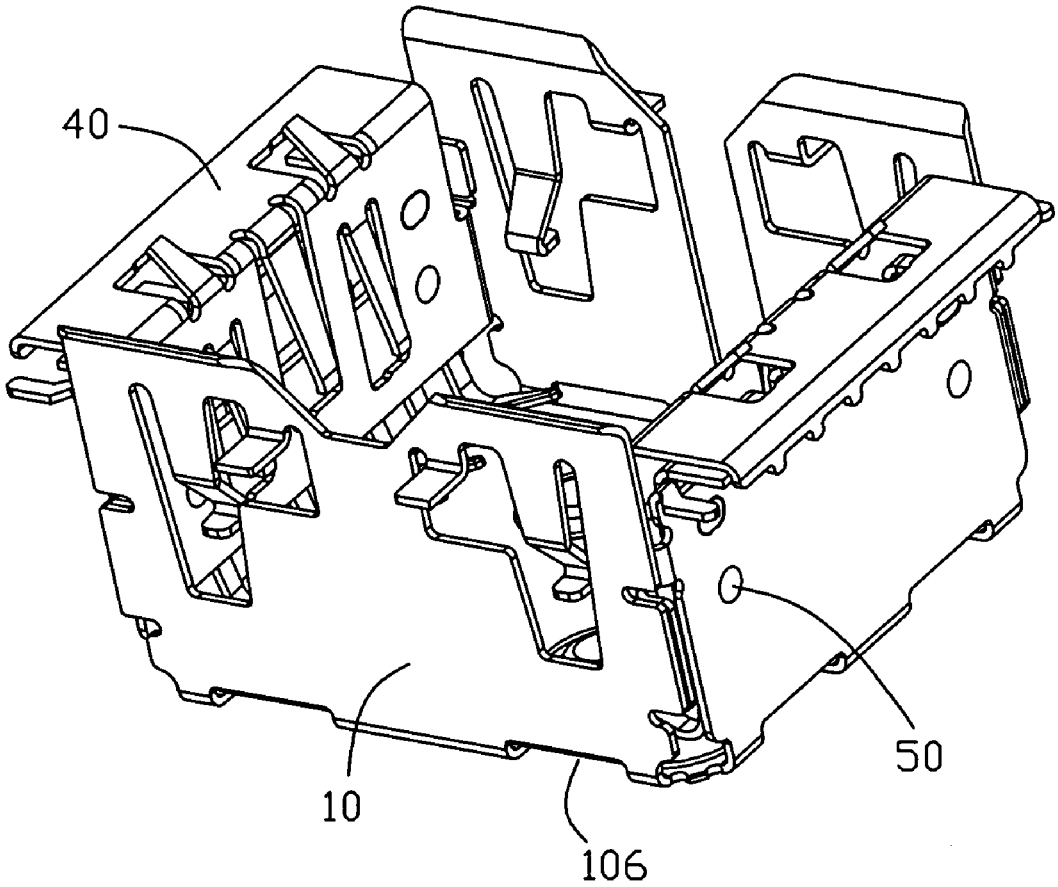
FIG. 3 is a perspective view of the shielded connector of the present invention.
Figure 4:
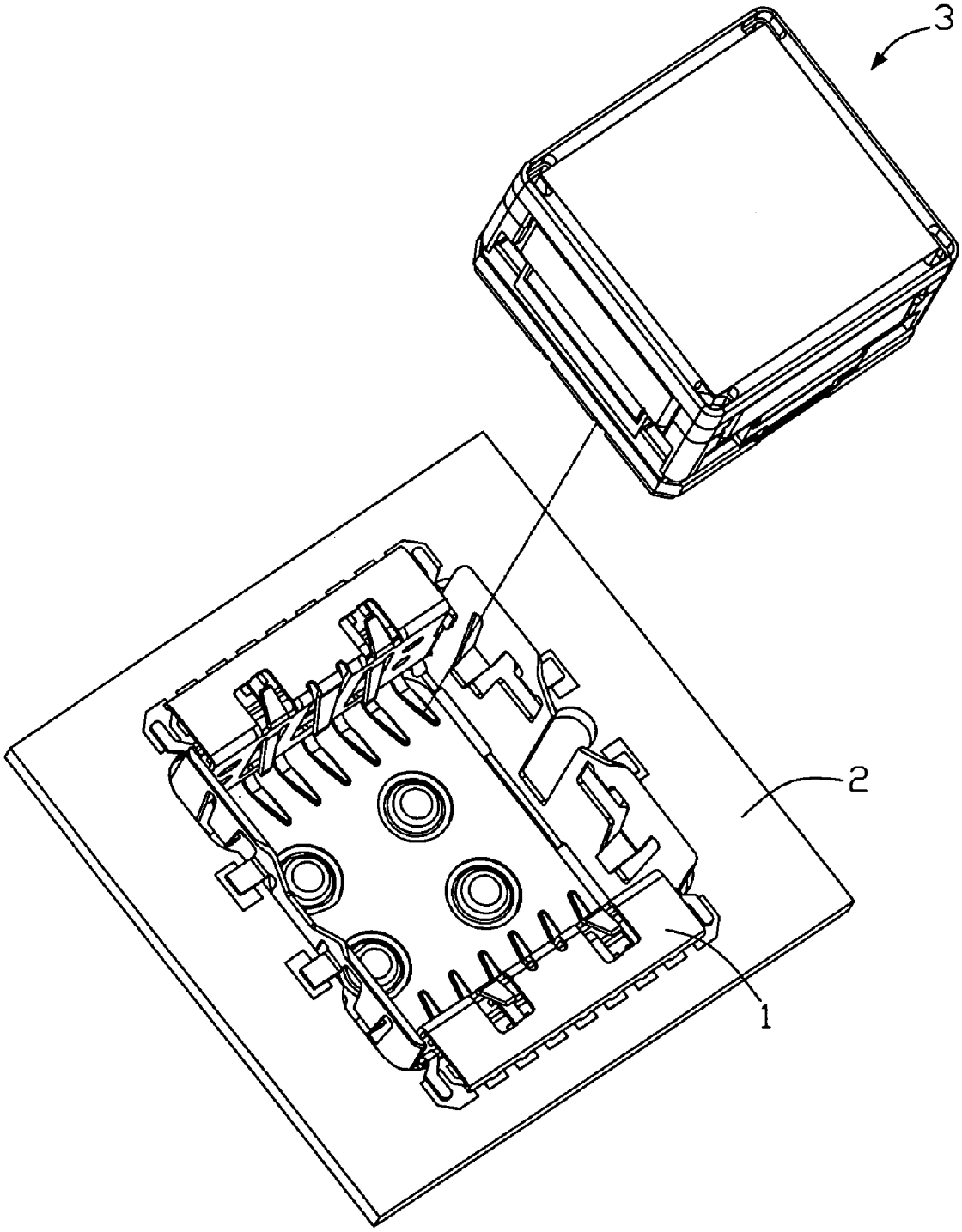
FIG. 4 is a perspective view of the shielded connector of the present invention, wherein the shielded connector have soldered on the printed circuit board and the camera module have not engaged with the shielded connector.
Figure 5:
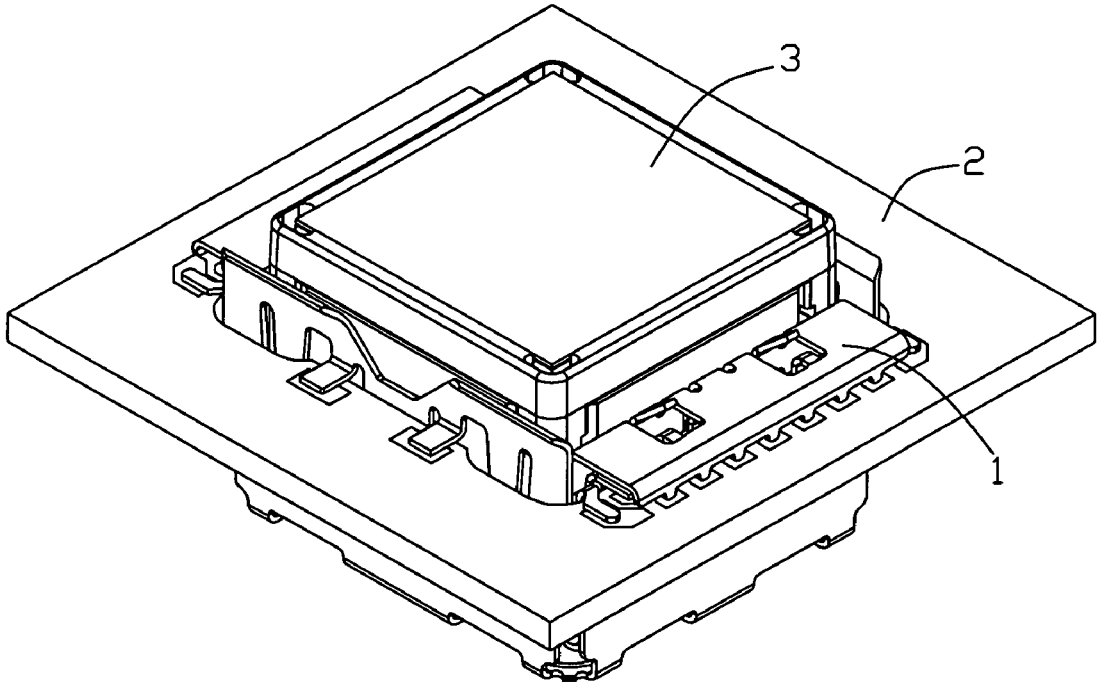
FIG. 5 is a perspective view of the shielded connector of the present invention, wherein the shielded connector have soldered on the printed circuit board and the camera module have engaged with the shielded connector.

FIG. 1 is an exploded perspective view of the shielded connector for receiving a camera module in the embodiment of this invention. In the figure, the reference numeral 10 denotes a metal housing made of metal material. The reference numeral 20 denotes a pair of insulating housings made of insulating material and the reference numeral 40 denotes a pair of metal shield made of metal material.

The metal housing 10 is made of metal material and configured by first 102, second 101, third 103, and fourth 100 sidewall defining a receiving space 104 therebetween. The metal housing 10 further includes a bottom wall (not labeled) connecting the first 102, second 101, third 103, and fourth 100 sidewalls. Wherein the second 101 and fourth 100 sidewalls have a section higher than the first 102 and third 103 sidewalls.

A window 1014 is provided on a second sidewall 101 for engaging with a corresponding portion of the camera module 3 in order to prevent the camera module 3 from being wrongly received in the receiving space 104. A plurality of locking fingers 1002, 1012 extend from the second and fourth sidewalls 101, 100 inward to a center of the receiving space 104 so as to contact with and retain the camera module 3. Each first and third sidewall 102, 103, has a number of first holes 1022 and first retaining holes 1024, which are arranged in two rows and run through the metal housing 10. A retaining portion 1026 is formed on the two ends of the first and third sidewalls 102, 103 in order to resist the end portion of the insulating housing 20. A plurality of soldering portions 1004, 1028, extend outwardly from the first, second, third, and fourth sidewalls 102, 101, 103, 100 along the horizontal direction in order to mount on the printed circuit board 2. Moreover, a slit 106 is formed between each sidewall and the bottom wall in order to provide a better verticality therebetween.

Referring again to FIG. 1, each insulating housing 20 is made of insulating material and configured as a flat plate. The insulating housings 20 are attached on the first and third sidewalls 102, 103 of the metal housing 10, respectively, by a number of second holes 200 corresponding with the first holes 1022, and a plurality of retaining sections 204 on a side thereof corresponding with the first retaining holes 1024 and also on an opposite side thereof.

A plurality of terminals 30 are configured in a "Z"-shape, each comprising a vertical/retaining section (not labeled) covered by the insulating housing 20, a soldering section 302 extending upwardly and outwardly from one end of the vertical section in order to mount on the printed circuit board, and a contact section 304 extending downwardly and slantly from the other end of the vertical section with a contact portion 306 to contact with the electrical pads formed on a bottom surface of the camera module 3. And an enlarged portion (not labeled) is formed on the end of vertical section and out of the insulating housing 20. The contact section 304 has a base portion 308, extending from the end of the enlarged portion and being closer to the receiving space 104 of the metal housing 10 than the vertical section. Moreover, the vertical section defines a plane extending therethrough, from which the base portion 308 is away.

Each metal shield 40 attached to the first and third sidewalls 102, 103 of the metal housing 10 comprises a vertical body portion 404 and a horizontal portion 402 extending laterally from an upper edge of the vertical body portion 404. The vertical body portion 404 has a flexible finger 4046 and a pair of resilient fingers 4048 located on two sides of the flexible finger 4046, all protruding inwardly for pressing the camera module 3. The vertical body portion 404 further comprises a pair of skirt portion 4040 to connect with the metal housing 10 by spot welding. The horizontal portion 402 has a plurality of soldering pads 4020 on the end thereof so as to connect to the printed circuit board 2. Furthermore, the vertical body portion 404 has a pair of third holes 4042 corresponding with the first holes 1022 of the metal housing 10 and the second holes 200 of the insulating housing 20, and a pair of second retaining holes 4044 corresponding with the first retaining holes 1024 of the metal housing 10 and the retaining section 204 of the insulating housing 20.

The shielded connector 1 further comprises a plurality of fastening means, such as a retaining stick 50, which penetrates the first holes 1022 of the metal housing 10, the second holes 200 of the insulating housing 20, and the third holes 4042 of the metal shield 40 in turn so as to provide a steady connection therebetween via interference engagement.

To combine FIGS. 2 to 5, in assembling the shielded connector 1, firstly, the terminals 30 are assembled with the insulating housing 20 by insert molding, with the vertical section being covered by the insulating housing 20, the enlarged portion being out of the insulating housing 20 downwardly, and the soldering section 302 being out of the insulating housing 20 upwardly. Secondly, the insulating housings 20 with the terminals 30 and the metal shield 40 are attached to the first and third sidewalls 102, 103 of the metal housing 10, with the retaining sections 204 of the insulating housing being inserted into the first retaining holes 1024 of the metal housing 10 and the second retaining holes 4044 of the metal shield 40, the retaining portions 1026 of the metal housing 10 bearing against the two ends of the insulating housings 20, the skirt portion 4040 of the metal shield 40 bearing against the second and fourth sidewalls 100, 101 of the metal housing 10 and being connected with the metal housing 10 by spot welding. The contact sections 304 of the terminals 30 extend into the receiving space 104 of the metal housing 10 so as to contact with the electrical pads formed on the bottom face of the camera module 3 and the soldering sections 302 extend outwardly of the insulating housings 20 so as to connect to the printed circuit board 2. Then, the retaining sticks 50 penetrate the first holes 1022 of the metal housing 10, the second holes 200 of the insulating housing 20, and the third holes 4042 of the metal shield 40 in turn by interference fit.

When the camera module 3 is inserted into the receiving space 104 from above, the contact pads on the bottom faces thereof are brought into contact with the contact sections 304 of the terminals 30, and the locking fingers 1002, 1012 of the metal housing 10, the flexible finger 4046 and the resilient fingers 4048 of the metal shield 40 contact with the outer periphery of the camera module 3 so as to hold the camera module 3 in the receiving space 104 steadily. Therefore, the camera module 3 is electrically connected to the printed circuit board 2 via the terminals 30. Finally, the shielded connector 1 with the camera module 3 is connected to the printed circuit board 2 by the soldering portions 1004, 1028, of the metal housing 10, the soldering sections 302 of the terminals 30, and the soldering pads 4020 of the metal shield 40.

In the above description of the preferred embodiment, there is a slit 106 at a portion between the sidewall and the bottom wall of the metal housing 10. Thus, the strength of the portion between the sidewall and the bottom wall is decreased. Consequently, it is very easy to bend a metal board into a shape of rectangle.

In the above description of the preferred embodiment, there is a slit at a portion between the sidewall and the bottom wall, while there is a slot/gap at the portion between the sidewall and bottom wall, it can also achieve the objective of our invention.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A shielded connector comprising:

a metal housing configured by sidewalls and a bottom wall commonly defining a receiving space therebetween for receiving an electronic device;

first and second insulative housing inserts securely attached to the sidewalls;

each of the insulative housings inserts including a plurality of terminals secured within an insulating material, each terminal including a tail portion extending from the insert away from the sidewalls, and a contact engaging portion extending from the insert toward a center of the receiving space of the metal housing;

a folding arrangement formed at a portion between the sidewall and the bottom wall of the metal housing;

wherein the shielded connector further including at least a metal shield attached to the insulative insert;

wherein the metal shield further comprising a pair of skirt portions substantially covering against the sidewalls of the metal housing;

wherein the shielded connector further including fastening means extending from the metal shield, through the insulative insert and anchored to the sidewall of the metal housing;

wherein the fastening means is a retaining rod/nail assembling the metal shield, the insulative insert, and the sidewalls of the metal housing to each other;

wherein each of the insulative housing inserts is pre-molded with a hole for receiving the retaining rod/nail; and wherein each of the insulative housing inserts is pre-molded with an aligning bud/post.

2. The shielded connector according to claim 1, wherein the folding arrangement is a slit/slot/gap.

3. The shielded connector according to claim 2, wherein the sidewalls of the metal housing comprises first, second, third, and forth sidewall connected to each other, the second and fourth sidewalls have a section higher than the first and third sidewall.

4. The shielded connector according to claim 3, wherein each second and fourth sidewalls includes locking fingers extending into a center of the receiving space of the metal housing.

5. The shielded connector according to claim 4, wherein each sidewall defines at least a soldering portion at the top edge thereof extending from the sidewall away from the receiving space.

6. The shielded connector according to claim 4, wherein a retaining portion, vertical to the first and third sidewall of the metal housing, is formed on the two ends thereof.

7. The shielded connector according to claim 1, wherein the metal shield includes a horizontal portion substantially covering the tail portion of the contact.

8. The shielded connector according to claim 1, wherein the metal shields includes resilient fingers extending into the receiving space of the metal housing.

9. The shielded connector according to claim 1, wherein the first and third sidewall of the metal shell is defined with a positioning recess in aligning with the aligning bud/post.

10. The shielded connector according to claim 9, wherein the metal shields includes resilient fingers extending into the center of the receiving space of the metal housing.

11. A shielded connector comprising:

a metal housing configured by sidewalls and a bottom wall commonly defining a receiving space therebetween for receiving an electronic device;

at least one insulative housing insert securely attached to the corresponding sidewall;

the insulative housing insert including a plurality of terminals secured within an insulating material, each terminal including a tail portion extending from the insert away from the sidewalls, and a contact engaging portion extending from the insert toward a center of the receiving space of the metal housing; wherein a common edge region extending along a longitudinal direction and shared by the bottom wall and at least one of said side walls defines at least one cutout which communicates the receiving space with an exterior in a transverse direction under a condition that said cutout does not extend beyond either end of said common edge region along said longitudinal direction; whereby strength around said common edge region is adjusted in a mild manner for easy forming a final shape of said metal housing;

wherein the shielded connector further including at least a metal shield attached to the insulative insert;

wherein the metal shield further comprising a pair of skirt portions substantially covering against the sidewalls of the metal housing;

wherein the shielded connector further including fastening means extending from the metal shield, through the insulative insert and anchored to the sidewall of the metal housing;

wherein the fastening means is a retaining rod/nail assembling the metal shield, the insulative insert, and the sidewalls of the metal housing to each other;

wherein the insulative housing insert is pre-molded with a hole for receiving the retaining rod/nail; and wherein the insulative housing insert is pre-molded with an aligning bud/post.

* * * * *